US010196933B2

(12) United States Patent
Ryczek et al.

(10) Patent No.: US 10,196,933 B2
(45) **Date of Patent: *Feb. 5, 2019**

(54) TRIPOD BUCKLE FOR SPLIT FAIRING OF A GAS TURBINE ENGINE

(71) Applicant: General Electric Company, Schenectady, NY (US)

(72) Inventors: Scott Patrick Ryczek, Cincinnati, OH (US); Derek Thomas Dreischarf, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,366

(22) Filed: Dec. 7, 2015

(65) Prior Publication Data

US 2016/0090862 A1 Mar. 31, 2016

Related U.S. Application Data

(63) Continuation of application No. 13/832,458, filed on Mar. 15, 2013, now Pat. No. 9,212,566.

(60) Provisional application No. 61/660,492, filed on Jun. 15, 2012.

(51) Int. Cl.

| | |
|---|---|
| ***F01D 5/14*** | (2006.01) |
| ***F01D 25/14*** | (2006.01) |
| ***F01D 9/00*** | (2006.01) |
| ***F01D 25/28*** | (2006.01) |
| ***F01D 9/04*** | (2006.01) |

(52) U.S. Cl.
CPC ..... *F01D 25/14* (2013.01); *F01D 9/00* (2013.01); *F01D 9/04* (2013.01); *F01D 25/28* (2013.01); *Y10T 29/49339* (2015.01)

(58) Field of Classification Search
CPC ..... F01D 25/14; F01D 25/28; F01D 9/00
USPC ..... 415/115, 208.1, 209.4
See application file for complete search history.

(56) References Cited

U.S. PATENT DOCUMENTS

| | | | | |
|---|---|---|---|---|
| 9,212,566 | B2 * | 12/2015 | Ryczek | F01D 25/14 415/115 |
| 2010/0132374 | A1 | 6/2010 | Mantegia et al. | |
| 2010/0135777 | A1 | 6/2010 | Mantegia et al. | |
| 2010/0135786 | A1 | 6/2010 | Manteiga et al. | |

* cited by examiner

*Primary Examiner* — Ching Chang
(74) *Attorney, Agent, or Firm* — General Electric Company; William Andes

(57) ABSTRACT

A fairing for a turbine engine strut includes: inner and outer bands; a vane extending between the bands; the fairing is split along a generally transverse plane passing through the bands and the vane, defining nose and tail pieces; wherein the vane is defined by spaced-apart sidewalls extending between a leading edge and a trailing edge, each sidewall split into forward and aft portions by the transverse plane; wherein each sidewall portion carries a radially-inwardly extending post, the posts positioned such that pairs of the posts lie adjacent to each other when the nose piece and tail piece are assembled, wherein each pair of adjacent posts includes at least two non-parallel faces; and a pair of slotted buckles, wherein each slotted buckle surrounds and clamps together a pair of the posts, wherein each pair of adjacent posts contacts a slot of the corresponding buckle in a tripod contact configuration.

19 Claims, 4 Drawing Sheets

TRIPOD BUCKLE FOR SPLIT FAIRING OF A GAS TURBINE ENGINE

BACKGROUND OF THE INVENTION

This invention relates generally to gas turbine engine turbines and more particularly to fairings for stationary structural members of such engines.

Gas turbine engines frequently include a stationary turbine frame, also referred to as an inter-turbine frame or turbine center frame ("TCF"), which provides a structural load path from bearings which support the rotating shafts of the engine to an outer casing, which forms a backbone structure of the engine. Turbine frames commonly include an annular, centrally-located hub surrounded by an annular outer ring, which are interconnected by a plurality of radially-extending struts. The turbine frame crosses the combustion gas flowpath of the turbine and is thus exposed to high temperatures in operation. Such frames are often referred to as "hot frames", in contrast to other structural members which are not exposed to the combustion gas flowpath.

To protect them from high temperatures, turbine frames are typically lined with high temperature resistant materials that isolate the frame structure from hot flow path gasses. The liner must provide total flow path coverage including the frame outer ring or case, hub structure, and struts.

One known configuration to protect the struts is an interlocking split fairing arrangement in which forward and aft sections of individual fairing/nozzle components are sandwiched around the struts. This arrangement uses a tab-and-buckle (or post-and-buckle) coupling assembly having a buckle with a rectangular opening that receives generally rectangular tabs to keep the fairing halves together after assembly to the frame. An example of this tab-and-buckle arrangement is described in U.S. Pat. No. 8,152,451 to Manteiga et al.

While effective to secure the fairing halves together, the prior art rectangular post/buckle configuration, however, requires tight tolerance match machining of the post and buckle to ensure alignment and fit of the members and relies on clearance gaps in the buckle joint to accommodate assembly. This can lead to gaps at assembly and in operation, creating potential "forward facing steps" and air leakage into the flowpath.

Accordingly, there is a need for a post-and-buckle joint for a turbine-strut fairing which is self-aligning.

BRIEF SUMMARY OF THE INVENTION

This need is addressed by the present invention, which provides a split fairing assembly for a turbine frame incorporating a self-aligning post-and-buckle coupling arrangement.

According to one aspect of the invention, a fairing for a strut in a gas turbine engine, includes; an inner band; an outer band; a hollow, airfoil-shaped vane extending between the inner and outer bands; wherein the fairing is split along a generally transverse plane passing through the inner band, outer band and vane, so as to define a nose piece and a tail piece; wherein the vane is defined by a pair of spaced-apart sidewalls extending between a leading edge and a trailing edge, each of the sidewalls being split into forward and aft portions by the transverse plane; wherein each of the sidewall portions carries a radially-inwardly extending post, the posts positioned such that pairs of the posts lie adjacent to each other when the nose piece and tail piece are in an assembled condition, wherein each pair of adjacent posts includes at least two non-parallel faces; and a pair of slotted buckles, wherein each slotted buckle surrounds and clamps together a pair of the posts, wherein each pair of adjacent posts contacts a slot of the corresponding buckle in a tripod contact configuration.

According to another aspect of the invention, a method is provided for assembling a fairing for a strut of a gas turbine engine. The method includes: Providing a fairing including: an inner band; an outer band; and a hollow, airfoil-shaped vane extending between the inner and outer bands; wherein the fairing is split along a generally transverse plane passing through the inner band, outer band and vane, so as to define a nose piece and a tail piece; wherein the vane is defined by a pair of spaced-apart sidewalls extending between a leading edge and a trailing edge, each of the sidewalls being split into forward and aft portions by the transverse plane; therein each of the sidewall portions carries a radially-inwardly extending post, wherein each pair of adjacent includes at least two non-parallel faces; positioning the nose piece and tail piece together in abutting relationship such that pairs of the posts lie adjacent to each other; and positioning a slotted buckle over each pair of posts such that each slotted buckle surrounds and clamps together the pair of posts, wherein each buckle contacts the corresponding pair of posts in a tripod contact configuration.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
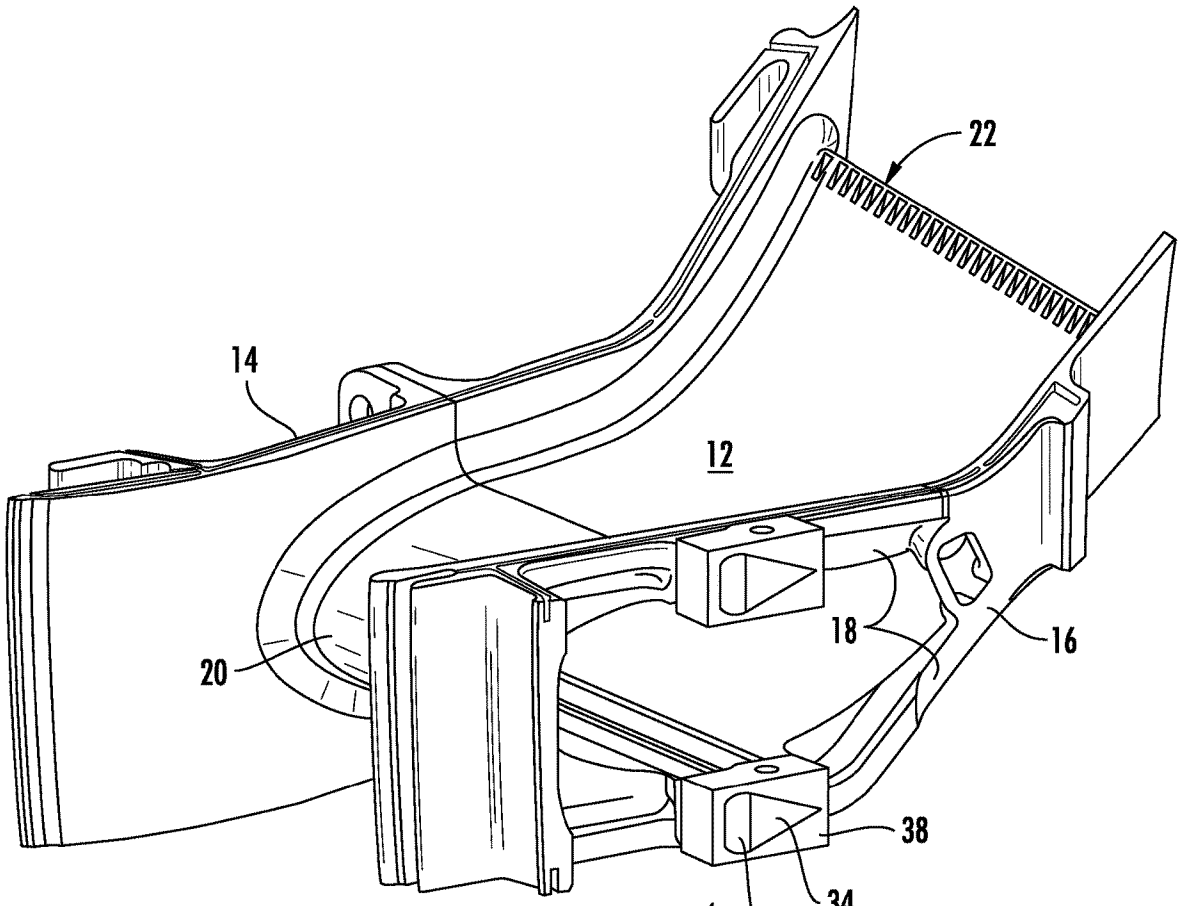
FIG. 1 is a perspective view of a strut fairing constructed according to an aspect of the present invention.

Referring to the drawings wherein identical reference numerals denote the same elements throughout the various views, FIG. 1 depicts a strut fairing 10 suitable for use in a gas turbine engine, for example to surround and protect a structural strut or a service tube of a structural frame. The strut fairing 10 includes an airfoil-shaped vane 12 that is supported between an arcuate outer band 14 and an arcuate inner band 16. The inner and outer bands 16 and 14 are axially elongated and shaped so that they define a portion of the flowpath through the turbine frame.

Figure 2:
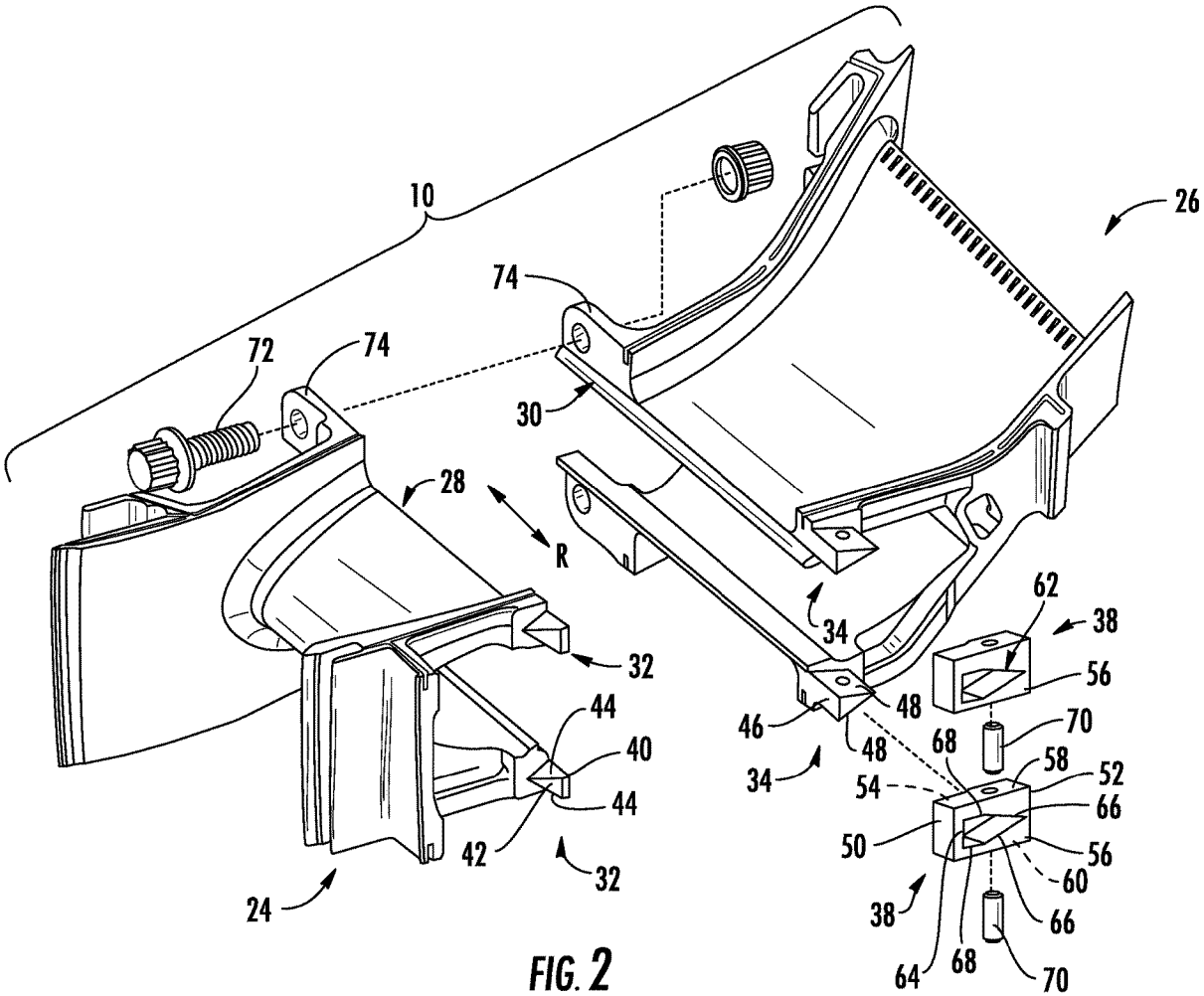
FIG. 2 is an exploded perspective view of the strut fairing of FIG. 1.

The vane 12 is axially elongated and includes spaced-apart side walls 18 extending between a leading edge 20 and a trailing edge 22. The sidewalls 18 are shaped so as to form an aerodynamic fairing for the a gas turbine engine frame strut or other similar structure of a known type (not shown) The components of the strut fairing 10, including the inner hand 16, outer band 14, and vane 12 are split, generally along a common transverse plane, so that the strut fairing 10 has a nose piece 24 and a tail piece 26 (see FIG. 2). Each of the sidewalls 18 is divided into forward and aft portions.

The nose pieces 24 and tail pieces 26 are cast from a metal alloy suitable for high-temperature operation, such as a cobalt- or nickel-based "superalloy", and may be cast with a specific crystal structure, such as directionally-solidified (DS) or single-crystal (SX), in a known manner. An example of one suitable material is a nickel-based alloy commercially known as RENE N4.

The interior lateral spacing between the sidewalls 18 is selected such that the nose piece 24 can slide axially over the strut or other structure from forward to aft, and the tail piece 26 can slide axially over the strut or other structure from aft to forward. This permits installation or removal of the nose piece 24 or tail piece 26 without disassembly of the turbine frame or removal of the strut. The inner lateral interior surfaces of the sidewalls 18 are substantially free of any protuberances, hooks, bosses, or other features that would interfere with the free axial sliding.

Optionally, the mating faces 28 and 30 of the nose piece 24 and the tail piece 26 may have a shape that is at least partially non-planar as a means of blocking leakage of cooling air or ingestion of hot flowpath gases.

Means are provided for securing the nose piece and the tail piece 24 and 26 to each other. In the illustrated example, the nose piece 24 includes posts 32 which extend in a generally radially inward direction adjacent its aft face 28, and the tail piece 26 includes posts 34 which extend in a generally radially inward directly adjacent its forward face 30. When assembled, the posts 32 and 34 are received in a slot 36 of a metallic buckle 38. (It is noted that to permit assembly, the posts 32 and 34 may be oriented in a direction that is not strictly radial to the engine centerline, but rather perpendicular to a waterline cut through the engine; that is, the posts 32 and 34 would be generally parallel to each other).

The posts 32 and 34 and the buckle 38 are collectively configured to define a "tripod" contact configuration which is self-aligning and which does not require precise match-machining of the component parts.

Each of the posts 32 includes a mating face 40 lacing the nose piece/tail piece split line, a pressure face 42 opposite the mating face 40, and a pair of spaced-apart side faces 44. The pressure face 42 is disposed at an acute angle "A" to an engine radial direction "R" (which is also parallel to the nosepiece/tailpiece split line).

Each of the posts 34 includes a mating face 46 facing the nose piece/tail piece split line, and a pair of spaced-apart side flank faces 48. The flank faces 48 are oriented to form a "V" shape, and in conjunction with the mating face 46 they form a generally triangular shape in plan view. The flank faces 48 extend generally parallel to the radial direction "R".

The buckle 38 is a monolithic structure with a forward and aft ends 50 and 52, inner and outer surfaces 54 and 56, and side surfaces 58 and 60. A slot 62 is formed in the buckle 38 extending from the inner surface 54 to the outer surface 56. The slot 62 includes a forward wall 64 adjacent the forward end 50, and a pair of flanking walls 66 adjacent the aft end 52. The forward wall 64 is generally planar and is inclined at an acute angle to the outer surface 56. The forward wall 64 is angled to as to lie generally parallel to the pressure face 42 of the post 32 when installed. Each of the flanking walls 66 is generally planar. The flanking walls 66 are oriented so as to lie generally parallel to the flank faces 48 of the post 34 when installed. The flanking walls 66 are oriented to form a "V" shape, and in conjunction with the forward wall 64 they form a generally triangular shape in plan view from the outer surface 56. Transition walls 68 may interconnect the flanking walls 66 and the forward wall 64. The slot 62 is sized and shaped such that there will be essentially no contact between the side laces 44 of the post 32 and the slot 62 when assembled.

Figure 3:
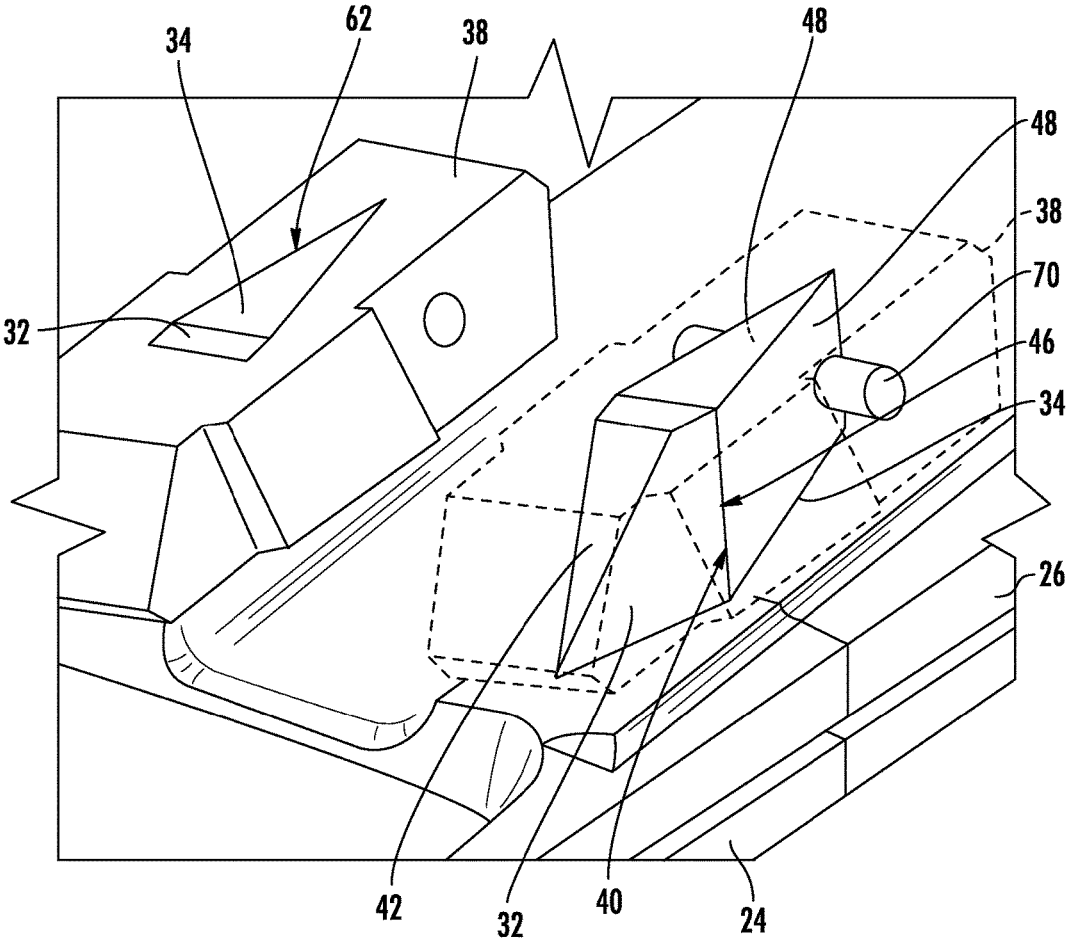
FIG. 3 is an enlarged perspective view of a buckle and post of the strut fairing of FIG. 1.

Referring to FIG. 3, when the nose piece 24 and the tail piece 26 are assembled, to each other, the mating face 40 of each post 32 contacts the mating face 46 of the corresponding post 34. The slot 62 of the buckle 38 receives the posts 32 and 34. The flanking walls 66 of the slot 62 bear against the corresponding flank faces 48 of the post 34, and the forward wall 64 of the slot 62 bears against the pressure face 42 of the post 32. As the buckle 38 is moved in a generally radial direction towards the nose piece 24 and tailpiece 26, interaction of the pressure face 42 forces the buckle 38 against the flank faces 48, removing substantially all of the clearance between the two posts 32 and 34, and between the buckle 38 and the posts 32 and 34. To the extent that the posts 32 and 34 and the slot 62 do not match their nominally-specified dimensions, the buckle 38 is simply forced on to the posts 32 and 34 to a greater or lesser degree.

Once the buckle 38 has been dry-fitted and all assembly clearance removed, the buckle 38 is temporarily secured to the post 34. For example, the buckle 38 could be tack-welded to the post 34. Alternatively, holes can be line-drilled through the buckle 38 and the post 34, and a press-fit pin 70 installed. The nose piece 24 can then be removed, and the buckle 38 is rigidly secured to the post 34, for example by a known brazing process.

To subsequently assemble the strut fairing 10 in an engine, the tail piece 26 is slipped axially forward over the strut. Next, the nose piece 24 is slipped axially rearward over the strut and pivoted so the posts 32 engage the slots 62.

Figure 4:
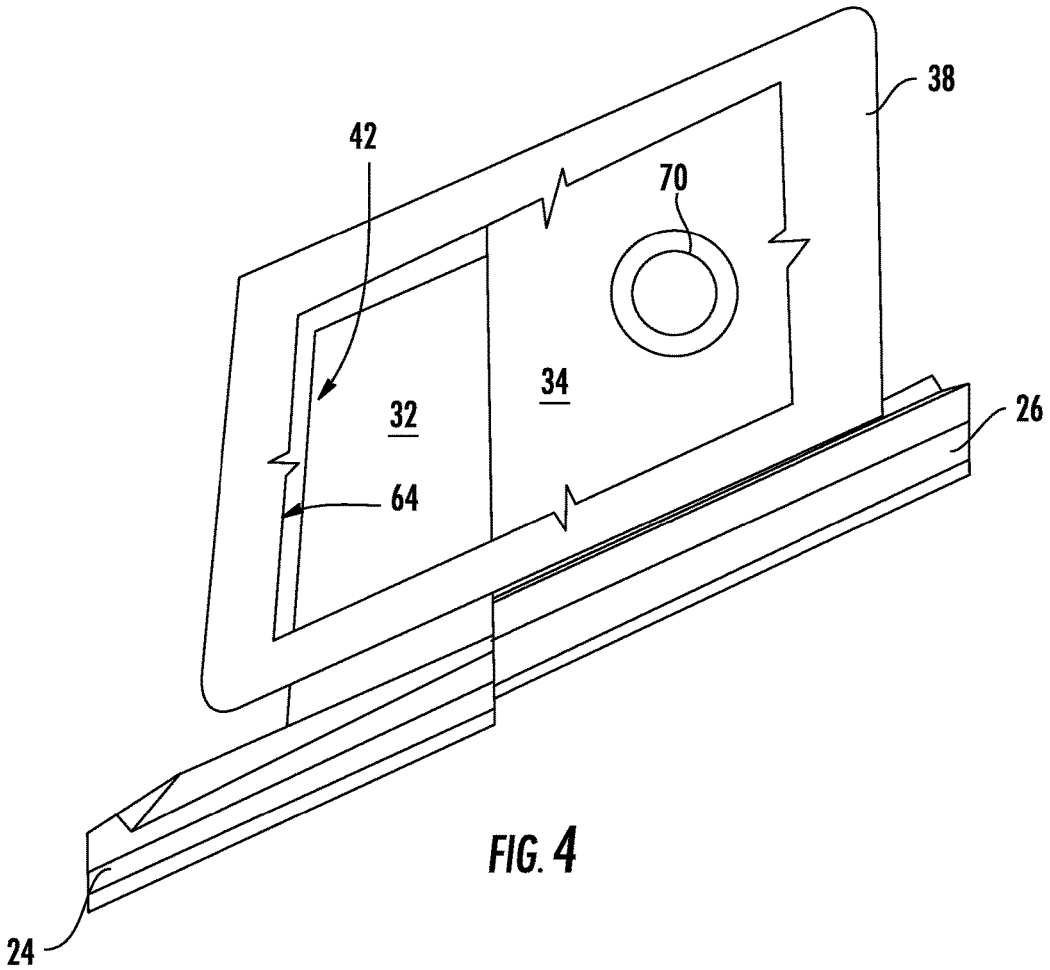
FIG. 4 is a partially-cut-away side view of the buckle and post of FIG. 3.

Finally, the radially outer ends of the nose and tail pieces 24 and 26 are secured together with shear bolts 72 or other similar fasteners installed through mating flanges 74 (see FIG. 1). When the nose piece 24 and tail piece 26 are assembled, interaction between the pressure face 42 and the forward wall 64 of the slot 62 resists movement of the nose piece 24. If the nose piece 24 should move in operation it can only move to a position which creates an aft-facing step relative to the combustion gas flowpath, not an undesirable forward-facing step (see FIG. 4).

It is noted that the buckle-and-post configuration described herein may be employed at the inboard end of a split fairing, at its outboard end, or at both ends.

The split fairing configuration described herein has several advantages over prior art designs, including: 1) Manufacturing tolerance relief, reducing cost. 2) Assembly ease through guided engagement, reducing cost. 3) Self-alignment of the joint, resulting in a zero-clearance fit. 4) Minimized flowpath gaps, abating wear. 5) Reduced leakage through flowpath gaps, improving engine performance. 6) Avoidance of forward facing steps into the flowpath, improving engine performance.

The present invention precludes the traditional tight tolerances required on the post and buckle that are necessary to achieve a matched fit to facilitate producibility, assembly and limited leakage loss at the split line. The proposed invention provides the added benefits of preventing aerodynamically undesirable steps into the flowpath at the split line while further reducing buckle-to-post assembly gaps, leading to a reduction in backside pressurization air leaking into the flowpath.

Cost is reduced due to relaxed tolerances and simplified assembly. The present invention allows utilization of an "as-cast" buckle, as opposed to a precision match machined detail part.

The foregoing has described a tripod buckle and split fairing for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A fairing for a strut in a gas turbine engine, comprising:

an inner band;

an outer band;

a hollow, airfoil-shaped vane extending between the inner and outer bands;

wherein the fairing is split along a generally transverse plane passing through the inner band, outer band and the hollow, airfoil-shaped vane, so as to define a nose piece and a tail piece;

wherein the hollow, airfoil-shaped vane is defined by a pair of spaced-apart sidewalls extending between a leading edge and a trailing edge, each of the pair of spaced apart sidewalls being split into forward and aft portions by the generally transverse plane;

wherein each of the pair of spaced-apart sidewalls carries a radially extending post, the radially extending posts positioned such that pairs of the radially extending posts lie adjacent to each other when the nose piece and tail piece are in an assembled condition, wherein each pair of adjacent radially extending posts includes at least two non-parallel faces; and a pair of slotted buckles, wherein each slotted buckle surrounds and clamps together a pair of the radially extending posts, wherein each pair of adjacent radially extending posts contacts a slot of a slotted buckle in a tripod contact configuration.

2. The fairing of claim 1 wherein the radially extending post of each spaced-apart sidewall portion of the tail piece includes a mating face and a pair of flank faces opposite the mating face, the flank faces oriented to form a "V" shape.

3. The fairing of claim 1 wherein the radially extending post of each spaced-apart sidewall portion of the nose piece includes a mating face, a pressure face opposite the mating face, and a pair of spaced-apart side faces flanking the pressure face, wherein the pressure face is disposed at an acute angle to the generally transverse plane.

4. The fairing of claim 3 wherein the slot is sized and shaped such that there will be substantially no contact between the spaced-apart side faces of the radially extending post and the slot when assembled.

5. The fairing of claim 1 wherein:

the slotted buckle is a monolithic structure with a forward and aft ends, inner and outer surfaces, and side surfaces;

a slot is formed in the slotted buckle extending from the inner surface to the outer surface, the slot including a forward wall adjacent the forward end, and a pair of flanking walls adjacent the aft end;

the flanking walls are oriented to form a "V" shape; and in conjunction with the forward wall, the flanking walls form a generally triangular shape in plan view from the outer surface.

6. The fairing of claim 5 wherein:

the forward wall of the slotted buckle is generally planar and is inclined at an acute angle to the outer surface, so as to lie generally parallel to the pressure face of the radially-outwardly extending post when installed; and each of the flanking walls of the buckle is generally planar, and the flanking walls are oriented so as to lie generally parallel to the flank faces of the radially extending post when installed.

7. The fairing of claim 1 wherein a pin passes through the slotted buckle and at least one of the radially extending posts.

8. The fairing of claim 1 wherein mating surfaces of the pair of spaced apart sidewalls have a nonplanar shape.

9. The fairing of claim 1 wherein the nose piece and the tail piece carry mating flanges configured to be coupled together by one or more fasteners.

10. The fairing of claim 1 wherein the slotted buckles are secured to the radially extending posts of the tail piece by brazing.

11. A method for assembling a fairing for a strut of a gas turbine engine, comprising:

providing a fairing including:

an inner band;

an outer band; and a hollow, airfoil-shaped vane extending between the inner and outer bands;

wherein the fairing is split along a generally transverse plane passing through the inner band, outer band and the hollow, airfoil-shaped vane, so as to define a nose piece and a tail piece;

wherein the hollow, airfoil-shaped vane is defined by a pair of spaced-apart sidewalls extending between a leading edge and a trailing edge, each of the spaced-apart sidewalls being split into forward and aft portions by the generally transverse plane;

wherein each of the pair of spaced-apart sidewalls carries a radially extending post, wherein each pair of adjacent radially extending posts includes at least two non-parallel faces;

positioning the nose piece and tail piece together in abutting relationship such that pairs of the radially extending posts lie adjacent to each other; and positioning a slotted buckle over each pair of radially extending posts such that each slotted buckle surrounds and clamps together the pair of radially extending posts, wherein each slotted buckle contacts the pair of radially extending posts in a tripod contact configuration.

12. The method of claim 11 wherein the radially extending post of each spaced-apart sidewall portion of the tail piece includes a mating face and a pair of flank faces opposite the mating face, the flank faces oriented to form a "V" shape.

13. The method of claim 11 wherein the radially extending post of each spaced-apart sidewall portion of the nose piece includes a mating face, a pressure face opposite the mating face, and a pair of spaced-apart side faces flanking the pressure face, wherein the pressure face is disposed at an acute angle to the generally transverse plane.

14. The method of claim 13 wherein the slotted buckle has a slot which is sized and shaped such that there will be substantially no contact between the spaced-apart side faces of the radially extending post and a slot when assembled.

15. The method of claim 11 wherein:

the slotted buckle is a monolithic structure with a forward and aft ends, inner and outer surfaces, and side surfaces;

a slot is formed in the slotted buckle extending from the inner surface to the outer surface, the slot including a forward wall adjacent the forward end, and a pair of flanking walls adjacent the aft end;

the flanking walls are oriented to form a "V" shape; and in conjunction with the forward wall, the flanking walls form a generally triangular shape in plan view from the outer surface.

16. The method of claim 15 wherein:

the forward wall is generally planar and is inclined at an acute angle to the outer surface, so as to lie generally parallel to the pressure face of the radially extending post when installed; and each of the flanking walls is generally planar, and the flanking walls are oriented so as to lie generally parallel to the flank faces of the radially extending post when installed.

17. The method of claim 11 further comprising:

forming holes through the slotted buckle and one of the radially extending posts received in a slot thereof; and installing a pin through the holes.

18. The method of claim 17 further comprising securing the slotted buckles to the radially extending posts of the tail piece by brazing.

19. The method of claim 11 wherein the nose piece and the tail piece carry mating flanges, the method further comprising coupling flanges together with one or more fasteners.

* * * * *